United States Patent [19]

Hinkel et al.

[11] 4,295,233

[45] Oct. 20, 1981

[54] AUTOMATIC HAND WASHER AND DRIER

[75] Inventors: Lester H. Hinkel, Benton Harbor; Lawrence E. Wolske, St. Joseph, both of Mich.

[73] Assignee: Whirlpool Corporation, Benton Harbor, Mich.

[21] Appl. No.: 93,906

[22] Filed: Nov. 13, 1979

Related U.S. Application Data

[63] Continuation of Ser. No. 866,175, Dec. 30, 1977, abandoned.

[51] Int. Cl.[3] ..... A47K 1/04; A47K 5/06; A47K 10/48; E03C 1/14

[52] U.S. Cl. ..... 4/619; 4/628; 4/630; 4/643; 52/35; 312/228

[58] Field of Search ..... 4/558, 623–626, 4/628, 630, 631, 638, 643, 647, 648, 650, 653, 443, 448, 191, DIG.7; 312/228; 52/34, 35; 248/146, 221.1, 221.3, 224.4; 34/90, 197; D23/49, 58

[56] References Cited

U.S. PATENT DOCUMENTS

| | | | |
|---|---|---|---|
| D. 124,423 | 12/1940 | Wilkinson | D23/49 |
| 1,144,191 | 6/1915 | Grey | 248/146 |
| 1,494,883 | 5/1924 | Bassette et al. | 4/638 |
| 1,765,915 | 6/1930 | Haase | 4/628 X |
| 2,192,383 | 3/1940 | Krolop | 4/626 |
| 2,281,370 | 4/1942 | Morrison et al. | 4/638 |
| 2,328,129 | 8/1943 | Earle | 34/197 |
| 2,426,152 | 11/1947 | Meldahl | 4/630 X |
| 2,504,740 | 4/1950 | Siegel | 34/90 |
| 2,767,407 | 10/1956 | Weiss | 4/653 |
| 2,786,211 | 3/1957 | Culver, Jr. | 4/626 |
| 3,065,473 | 11/1962 | Sprock et al. | 4/626 |
| 3,228,037 | 1/1966 | Winkler | 4/647 |
| 3,356,431 | 12/1967 | Martiniak | 312/228 X |
| 3,491,381 | 1/1970 | Cathcart | 4/623 |
| 3,508,282 | 4/1970 | Phillips, Jr. | 4/628 |
| 3,639,920 | 2/1972 | Griffin et al. | 4/558 |
| 3,813,706 | 6/1974 | Williams | 4/631 |
| 3,992,730 | 11/1976 | Davis | 4/624 |

FOREIGN PATENT DOCUMENTS

| | | | |
|---|---|---|---|
| 2360521 | 6/1975 | Fed. Rep. of Germany | 4/619 |
| 1185573 | 3/1970 | United Kingdom | 4/619 |

OTHER PUBLICATIONS

"Sweet's Architectural Catalogue File" copyright 1976 Section 15, 13f/HA-Haws Catalogue pp. 1–12.

RAS (Rohr Armature, Sanitär Heizung) Oct. 1970, p. 506.

*Primary Examiner*—Stuart S. Levy

*Attorney, Agent, or Firm*—Wegner, Stellman, McCord, Wood & Dalton

[57] ABSTRACT

A hand washing and drying apparatus having automatic means for providing hand washing material and hand drying air. The hand washing and drying operation is effected within a space defined by a bowl. The bowl may be recessed within the apparatus to facilitate an efficient use of warm water and warm air during the hand washing and drying operation. The hand drying air outlet may be mounted to the bowl for delivering the hand drying air directly thereinto. Similarly, a means for delivering hand washing material in the form of water may be mounted directly to the bowl. The automatic controls may include manually operable portions adapted to be manipulated by the user without substantially removing his hands from the bowl space. A soap dispenser may be mounted in the device adjacent the bowl space. The bowl may be provided with an upper arm extending at a forward angle for facilitated hand washing and drying. The apparatus may be arranged to be wall-mounted, with space provided below the lower front edge of the bowl permitting use thereof as by handicapped persons in wheelchairs as well as by normal users standing in front of the bowl. In a modified form, the drying air delivery apparatus and the washing water heating apparatus may be mounted to a rear panel of the outer cabinet of the apparatus. The device is arranged to be effectively self-cleaning in a simple and sanitary manner, such as in a restroom open to the public, permitting continued sequential use by a number of persons.

15 Claims, 8 Drawing Figures

FIG. 6
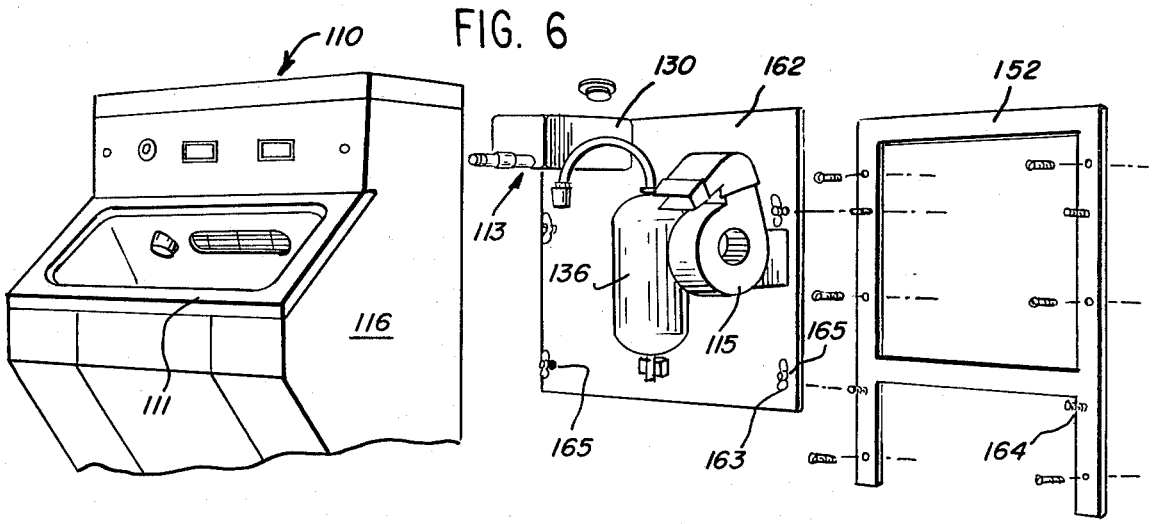
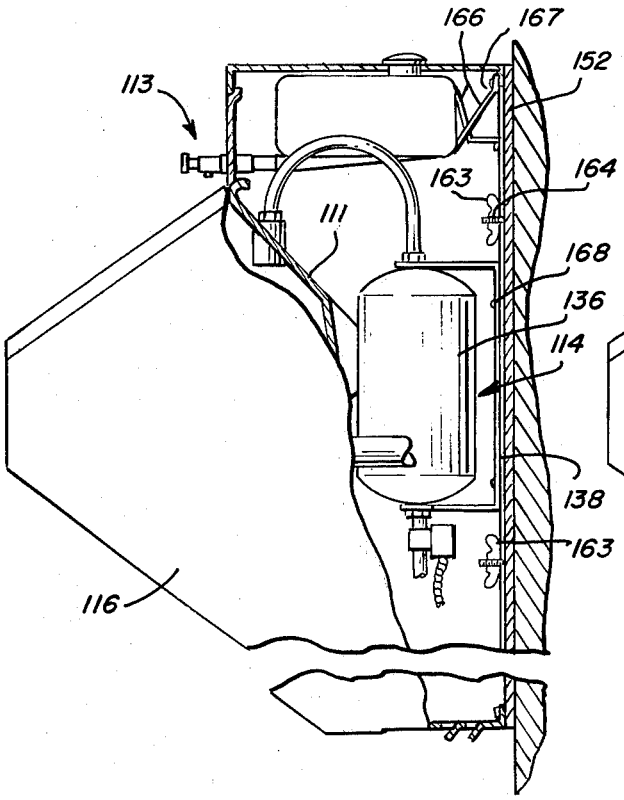
FIG. 7
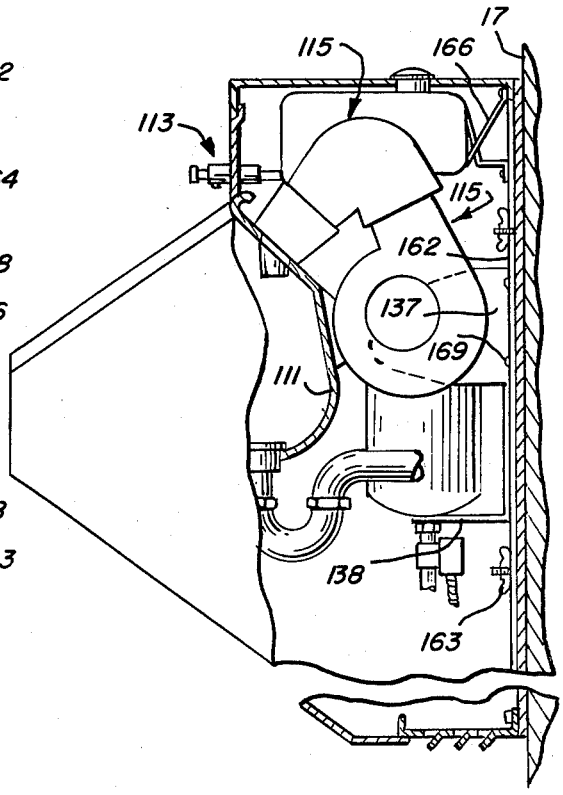
FIG. 8

AUTOMATIC HAND WASHER AND DRIER

This is a continuation of application Ser. No. 866,175 now abandoned filed Dec. 30, 1977.

BACKGROUND OF THE INVENTION

1. This invention relates to lavatories and in particular to automatic hand washing and drying apparatus.

2. Description of the Prior Art

The use of conventional lavatory sinks with adjacent towel or forced air hand drying means in public washrooms and the like is well known. A number of automatic devices have been developed for use in carrying out such hand washing and drying operations.

More specifically, as shown in U.S Pat No. 1,765,915 of Oscar Haase, an automatic apparatus for providing water, soap, hot air, and perfume for use in a hand washing and drying operation is illustrated. The apparatus is coin-operated so as to provide preselected times of delivery during the different delivery operations. Illustratively, the liquid soap is discharged for approximately five seconds, the washing water is delivered for approximately 20 seconds, and the drying air is delivered for approximately 40 seconds. The perfume may be delivered in the relatively short time of approximately three seconds. The apparatus is contained in a casing and thus is self-contained independently of any bowl or other means defining a hand washing and drying space. The delivery ducts are defined by a common discharge pipe aimed directly downwardly from the bottom of the casing. However, no bowl is provided for performing the hand washing and drying operation.

In U.S. Pat. No. 2,192,383 of Walter W. Krolop, a lavatory is shown including a hand washing bowl. A water-containing tank and liquid soap-containing tank are built into an upper portion of a cabinet partially enclosing the bowl. A water outlet is mounted in the upper portion of the bowl with a soap dispenser mounted to extend forwardly of the water outlet. A heater, such as a kerosene heater, is provided within the cabinet for heating the hand washing water in the tank. The water outlet is aimed parallel to the upper rim of the bowl. The soap dispenser is actuated by the user's hands within the bowl space, and the hot water delivery is effected by means of operation of a foot treadle engaged by the user's foot during the hand washing operation. No hand drying structure is included in the Krolop lavatory.

Willard L. Morrison et al disclosed, in U.S. Pat. No. 2,281,370, a combination washroom fixture having a conventional cabinet-mounted sink provided with hot and cold water faucets. The cabinet is filled with hot air heated by a heating coil and a blower is provided therein having a discharge flexible tube extending upwardly from a rear apron portion of the sink permitting the nozzle thereof to be pulled out to a desired position such as for drying the user's hands or hair. A foot pedal is disclosed for operating the drier fan motor. The hot air in the cabinet is used to heat the room in which the device is mounted at times when the air is not being delivered through the discharge nozzle. The outlets to the room are closed by a suitable control device when it is desired to use the discharge nozzle. In the normal position, the hot air discharge nozzle is located above the bowl of the sink and is aimed directly forwardly over the top of the sink, with the flexible hose connection thereof permitting selective positioning of the nozzle as desired by the user.

In U.S. Pat. No. 2,328,129, Guyon L. C. Earle shows a drier arrangement for dishes wherein heated air is delivered to a compartment above the rear of a sink so as to dry dishes or the like placed in the compartment after having been washed in the sink.

Louis L. Siegel, in U.S. Letters Pat. No. 2,504,740 shows a combination soad-dispensing device and hand dryer which are mounted in a housing adapted to be attached to a wall by suitable brackets so as to be disposed immediately above or adjacent a washbowl. Heated air is directed in a first path for drying the user's hands and in a second path for drying soap in the soap container. The device includes granulating means for providing granulated particles of soap from a bar provided within the soap dispenser.

Other prior art disclosures showing structure which may be used for hand washing and drying operations include the following U.S. Letters Patent:

| U.S. Pat. No. | Inventor | Title |
|---|---|---|
| Des. 124,423 | Wilkinson | Design for a Lavatory with Water Heater |
| 906,247 | Mahoney | Receptacle and Support Therefor |
| 1,494,883 | Bassette et al. | Lavatory Fixture |
| 2,786,211 | Culver, Jr. | Self-Serving Sink |
| 3,065,473 | Sporck et al. | Lavatory with Built-In Water Heater |
| 3,508,282 | Phillips, Jr. | Lavatory Unit |
| 3,639,920 | Griffin et al. | Programmed Plumbing Service |
| 3,992,730 | Davis | Scrub Sink |

SUMMARY OF THE INVENTION

The present invention comprehends an improved hand washing and drying device for soaping and automatic washing and drying of a user's hands with the hands being maintained substantially in the washing and drying space defined by a bowl portion of the apparatus. The washing material outlet and the drying air outlet open directly into the bowl portion; therefore washing and drying of the hands may be accomplished wholly within the enclosure defined by the bowl.

The apparatus permits control of each of the soaping, washing and drying operations by the user as desired so that the operations may be performed in any sequence with any of the operations being repeated as desired by the user.

The hand washing and drying device includes air-moving means having an outlet opening directly within a recessed bowl space for supplying the hand drying air directly to the space for improved drying of the user's hands.

The device further includes a warm water outlet which is disposed in the recessed bowl adjacent the drying air outlet. Means may be provided in the device for heating the water to a preselected washing temperature.

The recessed form of the bowl facilitates access to the bowl from in front of the device and efficient use of warm water and warm air used during the washing and drying operation.

The drying air and washing water outlets may be aimed downwardly into the bowl space so as to cause the air and water to flow downwardly in the bowl space and over the interior surface of the bowl.

A soap dispenser may be provided in the device to discharge soap directly into the bowl space, permitting the user to receive the soap with his hand retained effectively within the bowl space.

The bowl may be provided with an upper rim defining a plane extending at a forward angle of approximately 35° with respect to horizontal and may be mounted at an elevation above the floor level so as to effectively limit the use of the device to washing and drying operations. In a presently preferred embodiment, the lower lip of the bowl is approximately 37 inches (0.94 meters) from the floor level.

The bowl defines a bottom drain with the drying air outlet and warm water outlet being aimed from above, somewhat laterally of the drain.

The device includes electrically operable means and power supply-connecting means mounted to the rear portion thereof for removably plug-in connection to a conventional wall electrical power outlet. The device is arranged to cover the power outlet in the installed disposition.

The bowl defines a narrow upper rim portion effectively free of flat supporting surfaces contiguous thereto. The air outlet is mounted to the bowl substantially directly below the upper rim portion.

The water supply outlet is disposed below the plane of the bowl rim but spaced well above the lowermost portion of the rim. The air outlet is mounted substantially at the level of the water outlet.

In the illustrated embodiment, the soap dispenser is mounted above the bowl in laterally displaced relationship to the water outlet.

The manually operable means for causing the delivery of water and air may be mounted directly above the rim of the bowl so as to permit manual operation thereof without requiring substantial removal of the user's hands from the bowl space.

In a modified form of the invention, the warm water tank and warm air delivery means may be mounted to a rear panel of the outer cabinet and provided with means for conducting the washing water and drying air into the bowl space.

The rear panel may be removably secured to a hanger adapted to mount the apparatus on a wall or the like.

The hand washing and drying device of the present invention is extremely simple and economical of construction, while yet providing the highly desirable feature discussed above.

BRIEF DESCRIPTION OF THE DRAWING

Other features and advantages of the invention will be apparent from the following description taken in conjunction with the accompanying drawing wherein:

FIG. 6 is an exploded perspective view illustrating a modified form of the invention wherein the warm water tank, drying air providing means, and soap reservoir are mounted to a rear panel of the outer cabinet;

FIG. 7 is a fragmentary broken side elevation thereof; and

FIG. 8 is a broken fragmentary elevation thereof taken forwardly of the elevation of FIG. 7.

DESCRIPTION OF THE PREFERRED EMBODIMENT

Figure 2:
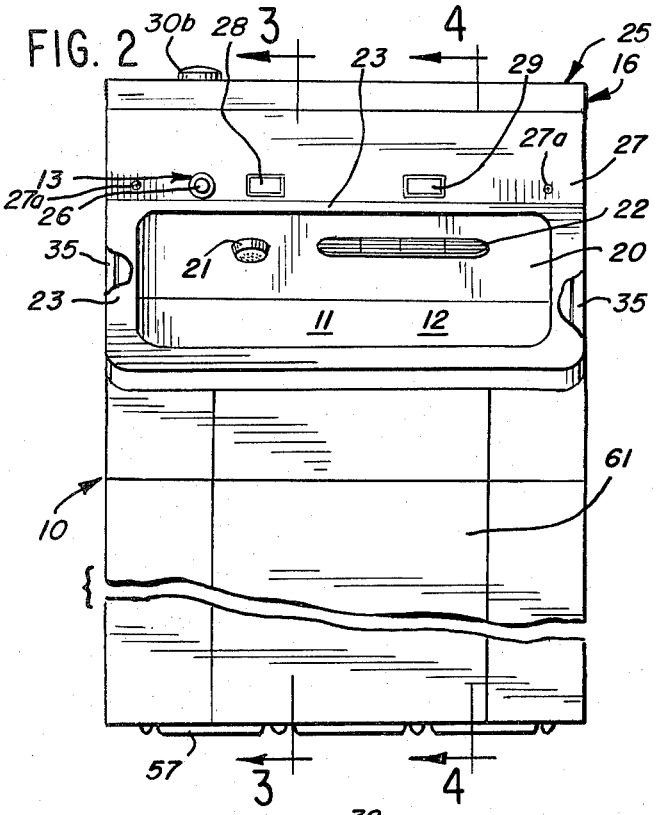
FIG. 2 is a front elevation thereof.

In the exemplary preferred embodiment of the invention as disclosed in FIGS. 1–5 of the drawing, a hand washing and drying device generally designated 10 is shown to include a bowl 11 defining a hand washing and drying space 12.

The ornamental design of the preferred embodiment of the invention is disclosed and claimed in copending United States Design patent application Ser. No. D-866,174 of Lawrence E. Wolske entitled "Multi-Purpose Plumbing Fixture Bowl and Cabinet Assembly" filed Dec. 30, 1977, and owned by the assignee hereof.

The device 10 is recessed so that the rear surface of the bowl 11 projects inwardly to provide a partially enclosed space to receive the hands for washing and drying operation. The device includes means provided for supplying hand washing material, including a soap dispenser 13 and a warm water supply 14. Means 15 are provided for supplying hand drying air. The bowl is mounted in a cabinet 16 which, as shown in FIG. 1, is arranged to be mounted to a suitable wall 17, as shown in FIG. 3, in vertically spaced relationship to a subjacent floor 18.

Figure 1:
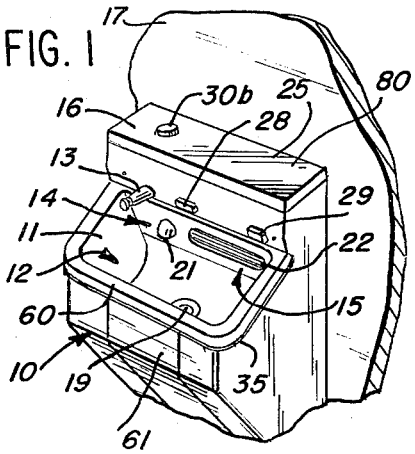
FIG. 1 is a fragmentary perspective view illustrating the mounting of the washing and drying device embodying the invention on a room wall.

As shown in FIG. 1, the bowl 11 defines a lower drain 19 for discharging spent washing water and soap from the device. The drain, as illustrated in FIG. 1, may be centrally located in the bottom of the bowl. As further illustrated in FIGS. 1 and 2, the bowl defines a concave rear wall 20 having a surface **20*a* on which is mounted a warm water outlet 21 of the warm water supply 14 and a drying air outlet 22 of the hand drying air supply 15. The mounting of the warm water supply means on the bowl structure and the mounting of the means for supplying hand drying air on the bowl structure are described in detail in copending U.S. application Ser. No. 866,176 of Lester H. Hinkel and Robert M. Chandler, entitled "Hand Washer and Drier Mounting Structure", filed Dec. 30, 1977, now abandoned and owned by the assignee hereof. As shown, the outlets 21 and 22 may be disposed adjacent the upper rim 23 of the bowl. The water outlet 21 is spaced at least 1" above the lower front edge of the bowl, thereby avoiding the need for a front edge drain to protect against siphoning of waste water into the fresh water supply. The concave rear wall 20 provides a recess 20*b* in a bowl 11** so that the hands may be partially enclosed to facilitate an efficient use of the warm water and warm air during the hand washing and drying operation.

Figure 3:
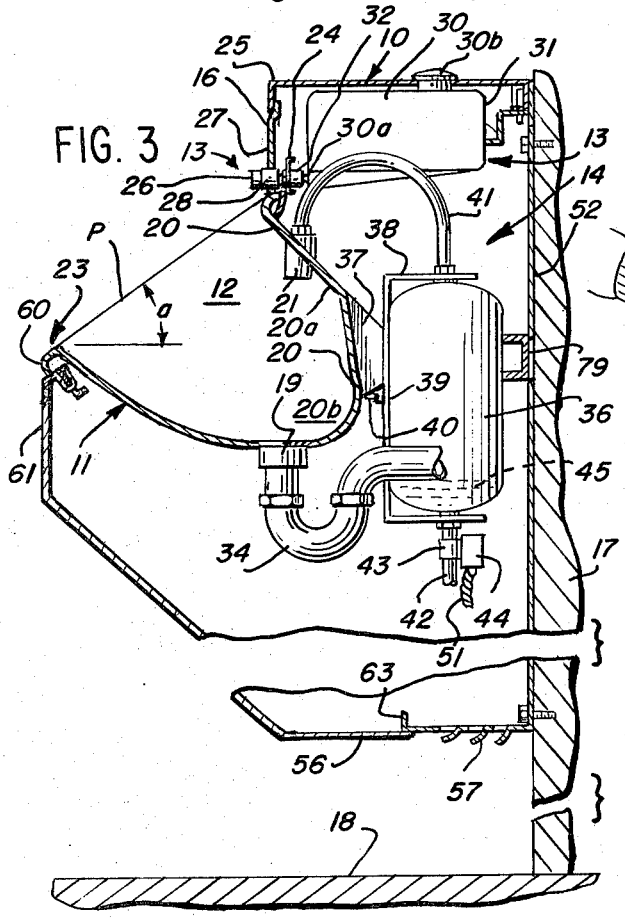
FIG. 3 is a fragmentary vertical section taken substantially along the line 3—3 of FIG. 2.

As shown in FIG. 3, the cabinet includes an outer cover portion 25. The soap dispenser 13 is provided with a manual operating means 26 extending forwardly through the front 27 of the cabinet 16 at the left side thereof, as best seen in FIG. 2. A manually operable control in the form of a push button 28 may be provided in the front portion 27 above the warm water outlet 21 for controlling the automatic delivery of warm water therethrough for a preselected period of time. A similar manually operable push button control 29 may be mounted in the cabinet portion 27 above the warm air outlet 22 for controlling the automatic delivery of hand drying air to the outlet 22 for a preselected period of time. As shown in FIG. 2, the controls 28 and 29 are disposed on an easily reached front portion of cabinet 16 substantially at the level of the top portion of rim 23 for effective actuation thereby, with the user effectively maintaining his hands within the bowl space 12 in the automatic operation and use of the device. The automatic operation of the device and the controls employed in the automatic operation of the device are described in detail in copending U.S. application Ser. No. 866,176 of Thomas R. MacFarlane and Richard G. Sickert entitled "Automatic Hand Washing and Drying Apparatus" filed Dec. 30, 1977, and copending U.S. application Ser. No. 866,173 of Thomas R. MacFarlane and Richard G. Sickert entitled "Water Supply Control for Automatic Hand Washing and Drying Apparatus" filed Dec. 30, 1977 now U.S. Pat. No. 4,144,596, both applications being owned by the assignee hereof.

Figure 4:
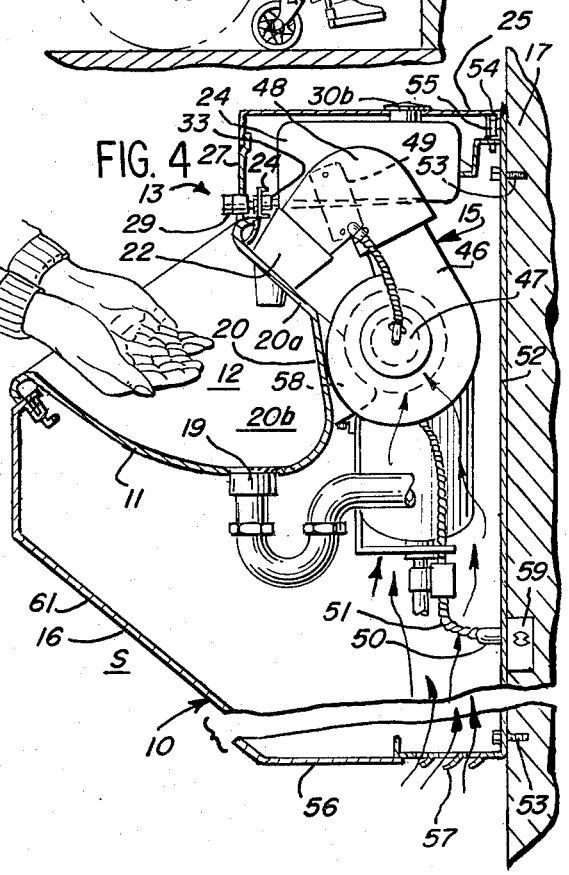
FIG. 4 is a fragmentary vertical elevation taken substantially along the line 4—4 of FIG. 2.

As shown in FIGS. 3 and 4, warm water outlt 21 and drying air outlet 22 are directed downwardly into the bowl space 12. As these outlets are displaced laterally from the drain 19, they direct the fluids delivered therefrom into the space and then along the surface of the bowl. Since the entire hand washing and drying operation takes place within the confines of the bowl, its walls substantially prevent the warm water and warm air from spilling outside the bowl before passing over the hands, maximizing efficient use of the warm water and warm air.

As shown in FIGS. 3 and 4, the soap dispenser 13 may include a reservoir 30 mounted within the cabinet 16, which is supported at the front by a hose 30*a* which connects reservoir 30 to dispenser 13 and at the rear by a support formed in the rear wall of the reservoir which rests on a flange projecting from a rear support member or cabinet 16. Soap is added to reservoir 30 through an opening in outer cover portion 25 which is closed by a soap dispenser cap 30*b*. As shown in FIG. 3, the warm water control 28 operates a control switch 32 carried on support 24 rearwardly of the front 27 and as shown in FIG. 4, the control 29 operates a switch 33. Screws 27*a* may be used to fasten front 27 to cabinet 16.

As shown in FIG. 3, the drain 19 may be connected to a sewer line or the like through a conventional drain trap 34. In the illustrated embodiment, rim 23 of the bowl rests on suitable flanges 35 (indicated in FIGS. 1 and 2) of the cabinet and is supported by the cabinet rather than by the drain trap which is slidably connected to drain 19, as shown in FIG. 3.

Warm water supply 14 further includes a water heating tank 36 which is carried on a boss 37 of the bowl 11 by means of suitable bracket 38 on tank 36 and mounting bracket 39 secured to boss 37 by suitable threaded securing means, such as bolts 40. The top of the heating tank is connected to the warm water outlet 21 by a suitable duct 41 and the lower end of the tank is connected to a cold water supply line 42 through a valve 43 controlled by a suitable electric solenoid 44.

As shown in dotted lines in FIG. 3, heating tank 36 may be provided in its lower portion with a conventional electrically energized immersion heating coil 45 for heating the water in tank 36 to a preselected hand washing temperature, say 105° F. (approximate). The heating coil is preselected to permit an effective continuous operation of the hand washing and drying device, i.e., by successive persons such as in continuous public restroom or washroom use.

As shown in FIG. 4, the air supply 15 further includes a blower 46 driven by a suitable electric motor 47. The blower delivers the hand drying air to a duct 48 in which is provided an electric heater 49 for suitably warming the hand drying air before discharge thereof through the air outlet 22 in the bowl rear wall 20.

As further shown in FIG. 4, device 10 may be provided with a conventional electrical connector plug 50 from which the power cord 51 extends to the different electrical devices within the apparatus.

Cabinet 16 may be hung to the wall 17 by means of a hanger 52 which may be secured to the rear wall by suitable screws 52. The cabinet may include upper hooks 54 adapted to engage suitable mounting bracket means 55 of the hanger 52 to carry the housing on the hanger. As shown in FIG. 4, the cabinet may include a bottom wall 56 provided with suitable air inlet louvers 57 for permitting air to be drawn upwardly from adjacent wall 17 (FIG. 3) into the cabinet 16 for delivery by blower 46 through the air outlet 22 into the bowl space 12.

As further shown in FIG. 4, blower motor 47 may be mounted to bowl 11 by means of bosses 58. Thus, in the illustrated embodiment of FIGS. 1–5, both the warm water supply means 14 including the warm water outlet 21 and the air drying means 15 including the air outlet 22 are supported by the bowl.

In the illustrated embodiments, the cabinet includes a removable front panel 61 permitting access to the space below bowl 11 within the cabinet such as for servicing the apparatus within the lower portion of the cabinet without the need for removing the entire device from the hanger 52.

As shown in FIG. 4, the electrical connector plug 50 may be arranged to be plugged into a conventional wall power outlet 59, permitting the device to be installed without requiring special electrical service. The provision of the connector plug 50 and the cabinet enclosure further provides the highly desirable feature of covering the outlet 59, precluding unauthorized access to the electrical power supply once the device is installed on wall 17, as shown in FIG. 4.

As thus seen in FIG. 3, rim 23 of the bowl 11 effectively defines a plane P extending at an angle a of 35° with respect to the floor level. The rim, as shown in FIG. 3, is relatively narrow. The front edge portion 60 of the rim is disposed above the floor 18 level approximately 37 inches (0.94 meters). In contrast, conventional lavatories and vanities are arranged with a substantially horizontal rim portion disposed in the range between 28 inches (0.71 meters) and 31 inches (0.787 meters) above floor level, and conventional urinal heights measure approximately 24 inches (0.609 meters) from the floor to the lip. Thus, the device of the present invention is arranged in the installation thereof, as shown in FIG. 3, the deter the use thereof as a urinal and effectively deter persons from sitting on the device and thereby putting undue strain on the wall mounting means.

Figure 5:
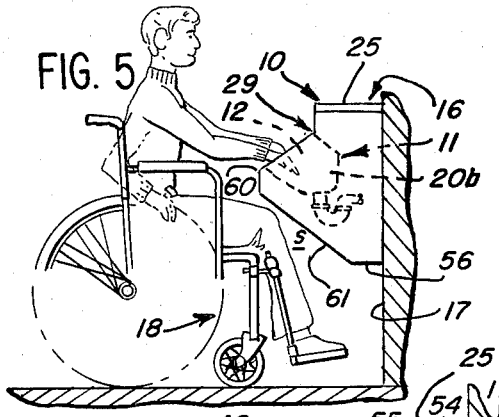
FIG. 5 is a fragmentary side elevation view, partially in section, illustrating the apparatus of the present invention in use by a person in a wheelchair.

An important feature of the present invention is the wall mounting of the cabinet so that it projects laterally from the wall, with a provision of space below the lower front edge of the bowl, facilitating use of the hand washer-drier as by handicapped persons in wheelchairs, as shown in FIG. 5. The portion of the cabinet which includes removable front panel 61 slopes back from the bowl front edge portion 60 to provide a substantial space s in front of the lower portion of the cabinet, and bottom wall 56 is spaced substantially above the floor level. Therefore, a person in a wheelchair can roll up to and closely approach the front of the hand washing and drying apparatus and easily manipulate the frontally accesible warm water and warm air controls 28 and 29 and wash and dry the hands within the frontally accessible recessed bowl, all without any undue reaching or strain, as shown in FIG. 5. Front portions of the wheelchair and the user's feet and legs can fit underneath front portions of the hand washing and drying apparatus cabinet 16 to facilitate the hand washing and drying operations by a user seated in a wheelchair, as shown in FIG. 5.

The temperature of the water heated in tank 36 is preselected to be the proper 105° F. temperature for effectively washing the user's hands while not being so hot as to cause injury. Thus, a single water outlet is utilized. By the simple arrangement shown in FIGS. 1 and 2, the operation of the device is essentially obvious to the normal user. Thus, the normal operation of the soap dispenser is conventional and thus obvious, and as the water control is disposed substantially directly above the warm water outlet, the use and functioning of these portions of the device will also be obvious to the normal user. Similarly, the disposition of the air drier control, button 29, directly above the air outlet 22, causes the functioning thereof to be obvious to the normal user. If desired, however, additional legends or suitable additional indicia may be employed.

The hand washing and drying device of the present invention is extremely simple, while yet providing an improved hand washing and drying functioning automatically and with minimum energy usage as the maintenance of the user's hands in the bowl during the soaping, washing, rinsing, and drying operations provides optimum utilization of the washing material and hand drying air. Further, as a result of the improved directing of the washing material and hand drying air into the bowl from outlets mounted in the rear wall thereof, an improved sanitized condition of the bowl surface is obtained. Concomitantly, by eliminating flat surfaces adjacent to the narrow rim of the bowl, collection of dirty water and the like is further avoided.

Additionally, the device is readily installed by means of the hanging thereof on the previously mounted hanger simply secured to the wall by means of the mounting screws 53. The automatic covering of the power supply as a result of the installation of the device on the wall provides additional protection against tampering with the power supply in a novel and simple manner.

Referring now to the embodiment of FIGS. 6, 7 and 8, a modified form of hand washing and drying device generally designated 110 is shown to comprise a device generally similar to hand washing and drying device 10 but having a removable rear panel 162 forming a rear wall of the cabinet 116.

As shown in FIG. 6, the soap dispenser reservoir 130 is mounted to the rear panel 162, and as shown in FIG. 7, may be so mounted by means of a bracket 166.

As further shown in FIGS. 6 and 7, the warm water tank 136 may be mounted to the rear panel 162 by a suitable mounting bracket 138. Bracket 166 may be secured to the panel 162 by suitable screws 167. Bracket 138 may be secured to the rear panel 162 by suitable screws 168.

As shown in FIG. 6 and 8, the air supply 115 may be mounted to the rear panel 162 by a bracket 137. Bracket 137 may be secured to the rear panel by suitable screws 169.

After the mounting of soap dispenser reservoir 130, warm water tank 136, and air supply 115 on rear panel 162, rear panel 162 is secured to the rear of cabinet 116 by suitable fastening means (not shown). After rear panel 162 has been assembled to cabinet 116, the assembly, including rear panel 162, is then removably secured to the hanger 152 by a plurality of wing nuts 163 (see FIGS. 6, 7 and 8) adapted to be threaded to threaded studs 164 carried by the hanger 152 and projecting through suitable openings 165 in the panel 162 when the panel with the reservoir, tank, and air supply mounted thereon, is brought into juxtaposition to the hanger 152, as shown in FIGS. 7 and 8.

In the illustrated embodiments, the bowl 11 may be formed of a suitable material, such as cast iron, provided with a suitable refractory coating, or the like. Bosses 37 and 58 may be formed integrally with the cast iron bowl so as to provide high strength in supporting the warm water supply 14 and air supply 15, as discussed above. Where the rear panel 162 is utilized (see FIGS. 6–8), the bowl may be formed of a less rigid material, such as stainless steel, molded plastic, etc. In the embodiment of FIGS. 6–8, the support of the soap dispenser 113, warm water supply 114, and drying air supply 115 is substantially independent of the bowl, with only the delivery elements of these apparatuses being mounted in the forward portion of the structure as seen in FIGS. 7 and 8.

The operation of the hand washing and drying device 110 is similar to that of the hand washing and drying device 10 discussed above. The structure thereof is generally similar and similar elements of device 110 are shown by the same reference numerals but 100 higher.

The foregoing disclosure of specific embodiments is illustrative of the broad and inventive concepts comprehended by the invention.

We claim:

1. A hand washing and drying device comprising:

a bowl defining an upwardly and forwardly opening hand washing and drying space, said bowl including a rear wall having a downwardly facing portion and having an upper substantially planar narrow rim extending at a substantial angle to the horizontal for deterring persons from sitting on said rim, said bowl further having a bottom drain underlying said rear wall portion;

water supply means including a water heating tank mounted closely adjacent said rear wall of the bowl and having an outlet opening substantially vertically downwardly generally toward said drain through said rear wall portion inwardly adjacent said rim for supplying wash water into said space in a first direction away from said rim, said outlet being spaced above the lowermost level of the rim; and air moving means including a blower mounted closely adjacent said rear wall of the bowl and having a horizontally elongaged outlet opening across said space through said rear wall portion adjacent said rim and at the level of said water supply means outlet for supplying hand drying air across said space in a second direction generally parallel to said rim.

2. The hand washing and drying device of claim 1 wherein said hand washing material supplying means includes a warm water supply having an outlet in said bowl rear wall portion adjacent said air moving means outlet.

3. The hand washing and drying device of claim 1 wherein said hand washing material supplying means includes a heating tank and heating means arranged to heat water therein for delivery to said space at a preselected hand washing temperature.

4. The hand washing and drying device of claim 1 wherein said air moving means includes an electric motor and power supplying connecting means are mounted to a rear portion of the device for removable plug-in connection to a conventional wall electrical power outlet.

5. The hand washing and drying device of claim 4 wherein said device covers the power outlet in the installed arrangement of the device.

6. The hand washing and drying device of claim 1 having an outer cabinet wherein the hand washing and drying space is recessed, whereby the hands may be partially enclosed during hand washing and drying, promoting an efficient use of hand washing material and hand drying air.

7. The hand washing and drying device of claim 1 wherein said bowl defines a rounded rearwardly recessed lower rear wall portion and said air moving means outlet is directed to cause the supplied air to flow downwardly through said space and be deflected by said bowl lower rear wall portion to pass upwardly along said upper rear wall portion and from an upper front portion of said space.

8. The hand washing and drying device of claim 1 wherein means are provided mounting the device with the lower edge of said rim at an elevation of approximately 37 inches (0.94 meters) above a subjacent floor level.

9. The hand washing and drying device of claim 1 wherein said air moving means outlet is at the upper edge of said rim.

10. The hand washing and drying device of claim 1 wherein a soap dispenser is disposed above the bowl in laterally adjacent relationship to said water supply outlet opening, and manually operable means for causing delivery of water from said water supply means outlet is mounted above said water supply means outlet and laterally of said soap dispenser.

11. The hand washing and drying device of claim 1 further including a cabinet for said device adapted for attachment to a vertical wall, said cabinet projecting laterally from said wall above floor level to provide a substantial clearance space below the lower front edge of the cabinet, said bowl being received within said cabinet, a drain conduit extending from said drain rearwardly immediately thereunder above said clearance space, and frontally accessible control means for said water supply means and said means for drying the user's hands, said clearance space below the lower front edge of the cabinet, said frontally accessible hand receiving space and said control means being arranged to permit use of the device by a user seated in a wheelchair extending to under said cabinet lower front edge.

12. The hand washing and drying device of claim 11 wherein the control means for said water supply means and the control means for said means for drying the user's hands are manually actuated and disposed on a forwardly accessible front portin of said cabinet.

13. The hand washing and drying device of claim 11 wherein said cabinet includes a rear wall and a hanger, means for mounting said hanger to said vertical wall, and means for removably mounting said rear wall to said hanger.

14. The hand washing and drying device of claim 13 wherein said cabinet further includes fingertip manipulatable means for removably said rear wall to said hanger.

15. The hand washing and drying device of claim 1 wherein said air moving means includes an air heating means.

* * * * *